US006977354B1

(12) United States Patent
Shea et al.

(10) Patent No.: US 6,977,354 B1
(45) Date of Patent: Dec. 20, 2005

(54) ARC HOOD AND POWER DISTRIBUTION SYSTEM INCLUDING THE SAME

(75) Inventors: John J. Shea, Pittsburgh, PA (US); Paul R. Rakus, Chippewa Township, PA (US); Michael H. Abrahamsen, Hendersonville, NC (US); Nathan J. Weister, Darlington, PA (US); Stanley E. Moore, Weaverville, NC (US); Neil E. Rowe, Asheville, NC (US); John A. Wafer, Moon Township, PA (US); Jeffrey A. Miller, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/980,466

(22) Filed: Nov. 3, 2004

(51) Int. Cl.[7] ..... H01H 33/02

(52) U.S. Cl. ..... 218/157; 218/35; 335/201

(58) Field of Search ..... 218/34–41, 7, 218/15, 155–158, 76, 81, 103–106, 147–149; 335/201, 202; 200/306

(56) References Cited

U.S. PATENT DOCUMENTS

| | | | | |
|---|---|---|---|---|
| 4,388,506 | A * | 6/1983 | Murai et al. | 218/156 |
| 6,288,621 | B1 * | 9/2001 | Rival | 335/201 |
| 6,348,666 | B2 * | 2/2002 | Rival et al. | 218/156 |
| 6,388,867 | B1 | 5/2002 | Rakus et al. | |
| 6,670,872 | B2 * | 12/2003 | Kurzmann | 335/201 |
| 6,762,389 | B1 * | 7/2004 | Crooks et al. | 218/157 |

* cited by examiner

*Primary Examiner*—Lincoln Donovan
*Assistant Examiner*—M. Fishman
(74) *Attorney, Agent, or Firm*—Martin J. Moran

(57) ABSTRACT

An arc hood includes a housing having a first chamber with two ends, a top and a bottom having an opening, and a smaller second chamber disposed on the top of the first chamber. The smaller second chamber includes two ends, a top and a bottom. Each of the ends of the second chamber have an opening, are disposed above the top of the first chamber, and are recessed from a corresponding one of the ends of the first chamber. The chambers define a passageway between the opening of the bottom of the first chamber and the openings of the ends of the second chamber. One or more baffles are within the housing and are disposed between the opening of the bottom of the first chamber and the openings of the ends of the second chamber. A seal is disposed about the opening of the bottom of the first chamber.

7 Claims, 12 Drawing Sheets

ARC HOOD AND POWER DISTRIBUTION SYSTEM INCLUDING THE SAME

BACKGROUND OF THE INVENTION

1. Field of the Invention

This invention pertains generally to power distribution systems and, more particularly, to such systems including switchgear cabinetry, a circuit breaker and an arc hood. The invention also relates to an arc hood.

2. Background Information

Low-voltage power circuit breakers with insulated housings typically have arc chute vents on the top of the housing. During overload and short circuit conditions, arc exhaust gas is expelled from the vents. The exhaust gas can be extremely hot and ionized and may carry metal vapor. Furthermore, the exhaust gas can carry stray current from the arc in the circuit breaker to grounded metal features in a sheet metal switchgear enclosure, thereby exceeding the limits allowed for ground current flow. The exhaust gas is also expelled with explosive force and may easily damage parts of that enclosure.

Switchgear cabinetry is typically designed to include one or more channels into which arc gases can be directed for dissipation thereof. In this regard, such switchgear cabinets typically include an arc hood that is mounted within each cell and disposed above the vents in the circuit breaker through which the arc gases are exhausted.

U.S. Pat. No. 6,388,867 discloses an arc hood mounted on a pair of spaced sidewalls of a circuit breaker cassette with a pair of brackets. The arc hood is positioned to extend over and be disposed at least partially adjacent the circuit breaker when the circuit breaker is in a racked position. The arc hood is of a generally upside down U-shape in cross section and thus provides a flow channel that is open at the opposite ends thereof. The circuit breaker is configured with a plurality of vents at the upper end thereof through which the arc gases are discharged. The arc gases are preferably discharged out of the immediate vicinity of the circuit breaker to avoid direct contact between the highly-ionized arc gases and the line contacts at the rear of the circuit breaker. The arc hood with its flow channel is thus provided to direct the arc gases flowing out of the vents in a sideways discharge direction and toward various regions of the switchgear cabinet where the arc gases can cool and become deionized. Since the arc gases are highly pressurized, at least a nominal portion of the arc gases undesirably flows or leaks through a gap in a leakage direction. A seal apparatus advantageously resists the flow of arc gases in the leakage direction. The seal apparatus includes a generally planar seal member and a plurality of fasteners. The seal member is a flexible strap that is manufactured out of an elostomeric material or other appropriate material that is suited to withstand the high temperatures and high pressures of the exhaust gases that are produced by the circuit breaker.

Typically, an insulated barrier is placed somewhere above the arc chute exit to manage the effects of the arc exhaust. At relatively high currents (e.g., over 100,000 A), however, the volume of exhaust gas, and the magnitude of the pressure wave from interruption, may damage the typical barrier and fill the enclosure with enough gas to conduct excessive currents to the various grounded metal features. The exhaust gas can even fill the area of the circuit breaker primary connections and trigger spontaneous arcs among the conductors. An improved arc hood is, therefore, needed which can contain and diffuse the damaging pressure wave while cooling and de-ionizing the exhaust gas before allowing it into the general enclosure space.

Relatively higher voltage applications (e.g., up to 1000 V and higher) of power circuit breakers also encounter arcs among the conductors and to the enclosure ground due to arcing exhaust gas, even at modest levels of overload and short circuit current. An improved arc hood is needed that requires less auxiliary insulation in the enclosure and allows new applications for low-voltage and relatively higher voltage circuit breakers without arc exhaust gas difficulties.

Accordingly, there is room for improvement in arc hoods and in power distribution systems employing the same.

SUMMARY OF THE INVENTION

These needs and others are met by the present invention, which provides an arc hood including a housing having a first chamber and a smaller second chamber disposed on top of the first chamber. Each of the ends of the smaller second chamber have an opening that is disposed above the top of the first chamber, and that is recessed from a corresponding one of the ends of the first chamber. The first and second chambers define a passageway between the opening of the bottom of the first chamber and the openings of the ends of the smaller second chamber. One or more baffles are within the housing and are disposed between the opening of the bottom of the first chamber and the openings of the ends of the smaller second chamber.

In accordance with one aspect of the invention, an arc hood comprises: a housing comprising: a first chamber comprising two ends, a top and a bottom having an opening, and a smaller second chamber disposed on the top of the first chamber, the smaller second chamber including two ends, a top and a bottom, each of the ends of the smaller second chamber having an opening, being disposed above the top of the first chamber, and being recessed from a corresponding one of the ends of the first chamber, the smaller second chamber and the first chamber defining a passageway between the opening of the bottom of the first chamber and the openings of the ends of the smaller second chamber; at least one baffle within the housing and being disposed between the opening of the bottom of the first chamber and the openings of the ends of the smaller second chamber; and a seal disposed about the opening of the bottom of the first chamber.

The at least one baffle may be single baffle that is a generally planar screen disposed between the first chamber and the smaller second chamber.

The at least one baffle may be two baffles including a first L-shaped baffle and a second L-shaped baffle, each of the first and second L-shaped baffles having a first portion that is generally parallel to the bottom of the first chamber and a second portion that is generally parallel to a corresponding one of the ends of the smaller second chamber.

The at least one baffle may include at least one first screen and at least one second screen, each of the at least one first and second screens being generally parallel to a corresponding one of the ends of the smaller second chamber.

The at least one baffle may be a plurality of baffles comprising: a first L-shaped baffle; a second L-shaped baffle, each of the first and second L-shaped baffles having a first portion that is generally parallel to the bottom of the first chamber and a second portion that is generally parallel to a corresponding one of the ends of the smaller second chamber; at least one first screen; and at least one second screen, each of the at least one first and second screens being generally parallel to a corresponding one of the ends of the smaller second chamber.

The baffles may further comprise a screen in the passageway between the opening of the bottom of the first chamber and the openings of the ends of the smaller second chamber.

The at least one first screen may be a plurality of generally parallel first screens; and the at least one second screen may be a plurality of generally parallel second screens.

The bottom of the first chamber of the housing may include a groove proximate the opening thereof. The seal may be an elastomer seal disposed in the groove.

The bottom of the first chamber of the housing may include a groove proximate the opening thereof. The seal may have a cross section with an L-shape including a first portion disposed in the groove and a second portion having a free end disposed toward the opening of the bottom of the first chamber.

The first chamber of the housing may further comprise a first side proximate the opening of the bottom thereof and a second side proximate the opening of the bottom thereof. The seal may include a top portion, a bottom portion, a first side, a second side and two ends, the top and bottom portions of the seal having a plurality of openings therebetween, the first side of the seal pivotally engaging the first side of the first chamber, the second side of the seal having a flange adapted to engage the second side of the first chamber, the seal being adapted to pivot in a first direction about the first side of the seal, the second side of the seal being adapted to alternately move away from the housing and move toward the housing until the flange of the second side of the seal engages the second side of the first chamber.

The first chamber of the housing may include a first divider and a second divider therein. The ends of the first chamber may include a first end having a first opening therein and a second end having a second opening therein. The first and second chambers of the housing may define an opening therebetween and between the first and second dividers, the first and second dividers may further define a first entrance, a second entrance and a third entrance into the opening of the bottom of the first chamber of the housing, the first divider being adapted to direct gas from the first entrance to the first opening of the first end of the first chamber, the second divider being adapted to direct gas from the second entrance to the second opening of the second end of the first chamber, the first and second dividers being adapted to direct gas from the third entrance to the openings of the ends of the second chamber.

As another aspect of the invention, a power distribution system may comprise: a switchgear cabinet; a circuit breaker carried by the switchgear cabinet, the circuit breaker including at least one vent; an arc hood comprising: a housing comprising: a first chamber comprising two ends, a top and a bottom having an opening, and a smaller second chamber disposed on the top of the first chamber, the smaller second chamber including two ends, a top and a bottom, each of the ends of the smaller second chamber having an opening, being disposed above the top of the first chamber, and being recessed from a corresponding one of the ends of the first chamber, the smaller second chamber and the first chamber defining a passageway between the opening of the bottom of the first chamber and the openings of the ends of the smaller second chamber; at least one baffle within the housing and being disposed between the opening of the bottom of the first chamber and the openings of the ends of the smaller second chamber; and a seal disposed about the opening of the bottom of the first chamber.

The arc hood may be disposed at least partially adjacent the circuit breaker and be structured to direct arc gases discharged by the circuit breaker through the opening of the bottom of the lower chamber of the housing, through the passageway, through the at least one baffle within the housing, and through the openings of the ends of the smaller upper chamber.

The at least one baffle may be above the first chamber of the housing.

The at least one baffle may be offset from the ends of the lower chamber of the housing.

The circuit breaker may include a pair of ends. The at least one baffle may be offset from the ends of the lower chamber of the housing and from the ends of the circuit breaker.

The at least one baffle may be a plurality of baffles comprising: a first L-shaped baffle; a second L-shaped baffle, each of the first and second L-shaped baffles having a first portion that is generally parallel to the bottom of the first chamber and a second portion that is generally parallel to a corresponding one of the ends of the smaller second chamber; a plurality of generally parallel first screens; a plurality of generally parallel second screens, each of the generally parallel first and second screens being generally parallel to a corresponding one of the ends of the smaller second chamber; and at least one screen in the passageway between the opening of the bottom of the first chamber and the openings of the ends of the smaller second chamber.

As another aspect of the invention, an arc hood comprises: an arc hood housing comprising: a first chamber comprising two ends, a top and a bottom having an opening, and a smaller second chamber disposed on the top of the first chamber, the smaller second chamber including two ends, a top and a bottom, each of the ends of the smaller second chamber having an opening, being disposed above the top of the first chamber, and being recessed from a corresponding one of the ends of the first chamber, the smaller second chamber and the first chamber defining a passageway between the opening of the bottom of the first chamber and the openings of the ends of the smaller second chamber; and a seal disposed about the opening of the bottom of the first chamber.

As another aspect of the invention, an arc hood comprises: an arc hood housing comprising: a first chamber comprising two ends, a top and a bottom having an opening, and a smaller second chamber disposed on the top of the first chamber, the smaller second chamber including two ends, a top and a bottom, each of the ends of the smaller second chamber having an opening, being disposed above the top of the first chamber, and being recessed from a corresponding one of the ends of the first chamber, the smaller second chamber and the first chamber defining a passageway between the opening of the bottom of the first chamber and the openings of the ends of the smaller second chamber.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is described in association with an arc hood assembly for a draw-out circuit breaker, although the invention is applicable to arc hoods for a wide range of circuit interrupters.

Figure 8:
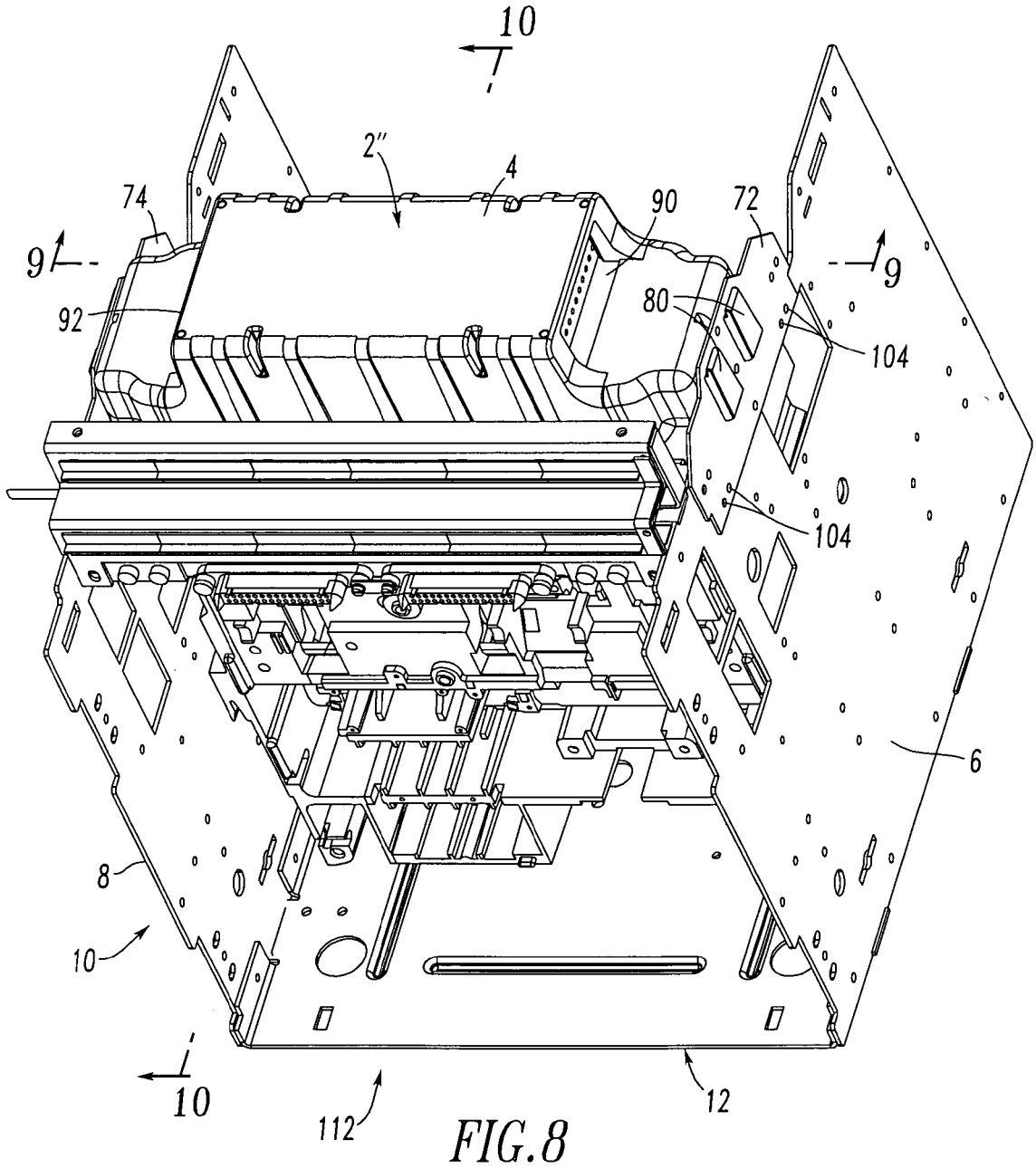
FIG. 8 is an isometric view of a circuit breaker cassette and arc hood assembly in accordance with another embodiment of the invention.

Referring to FIGS. 1–4, an arc hood assembly 2 includes a housing, such as a molded shell 4, that is adapted for mounting to draw-out "cassette" sides 6,8 (as shown in FIG. 8 with another arc hood assembly 2"), to the ceiling of another switchgear enclosure (not shown), or to a circuit breaker or other circuit interrupter for fixed-mounting (not shown). The arc hood assembly 2 is open on its bottom and may be spaced a relatively short distance above, for example, a switchgear cabinet, such as circuit breaker housing 10 (FIG. 8), thereby allowing the circuit breaker (not shown) to be levered in and out of the cassette 12 (FIG. 8). The arc hood assembly 2 spans the arc chute vents of one or more poles 14,16,18 as best shown with assembly 2" in FIG. 9.

Figure 1:
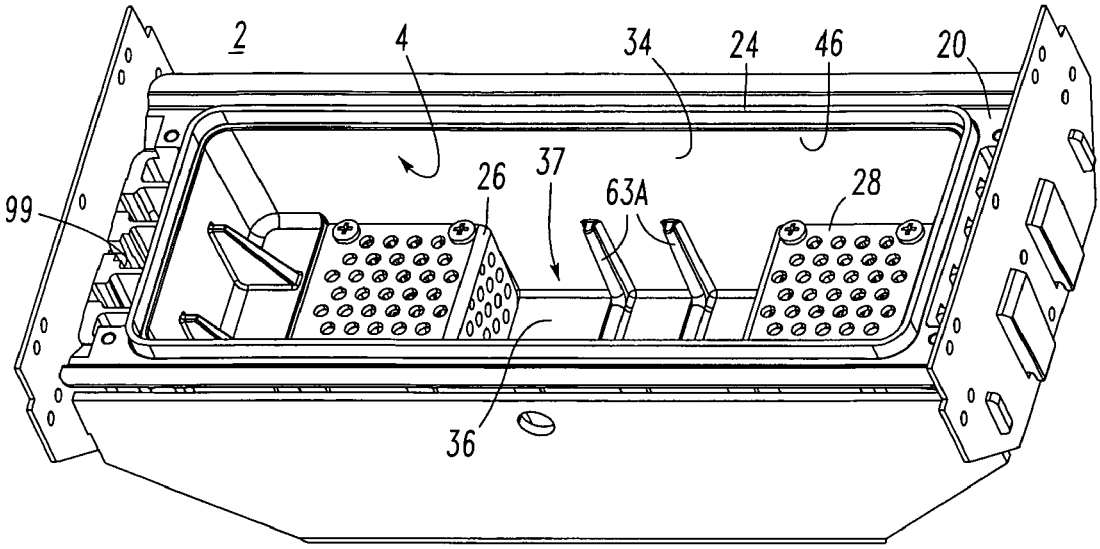
FIG. 1 is a bottom isometric view of an arc hood assembly including one or more baffles in accordance with the present invention.
Figure 2:
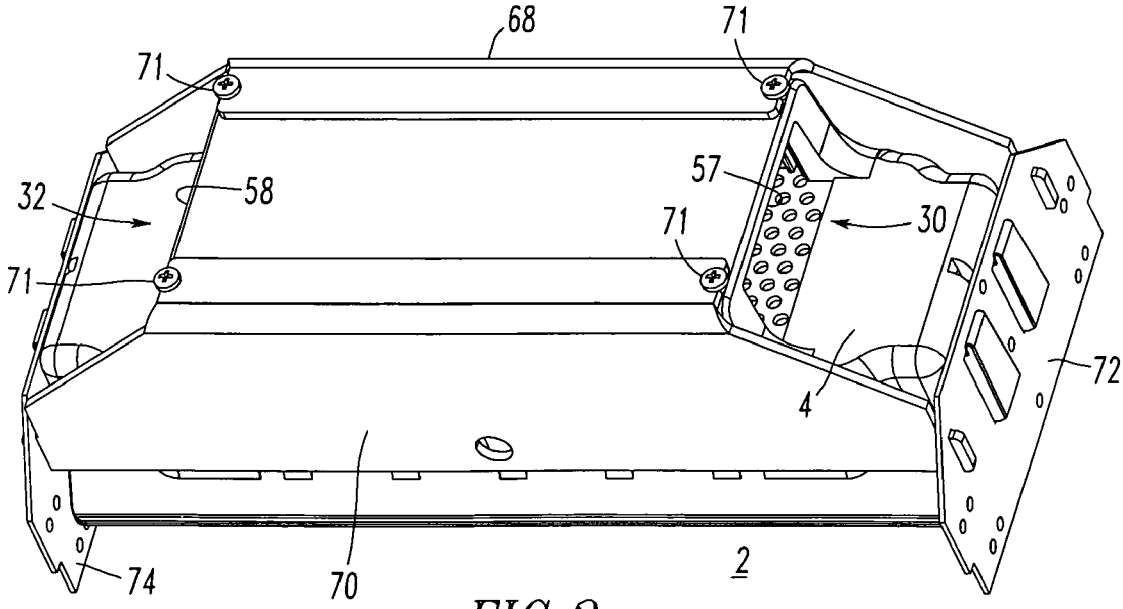
FIG. 2 is a top isometric view of the arc hood assembly of FIG. 1.
Figure 3:
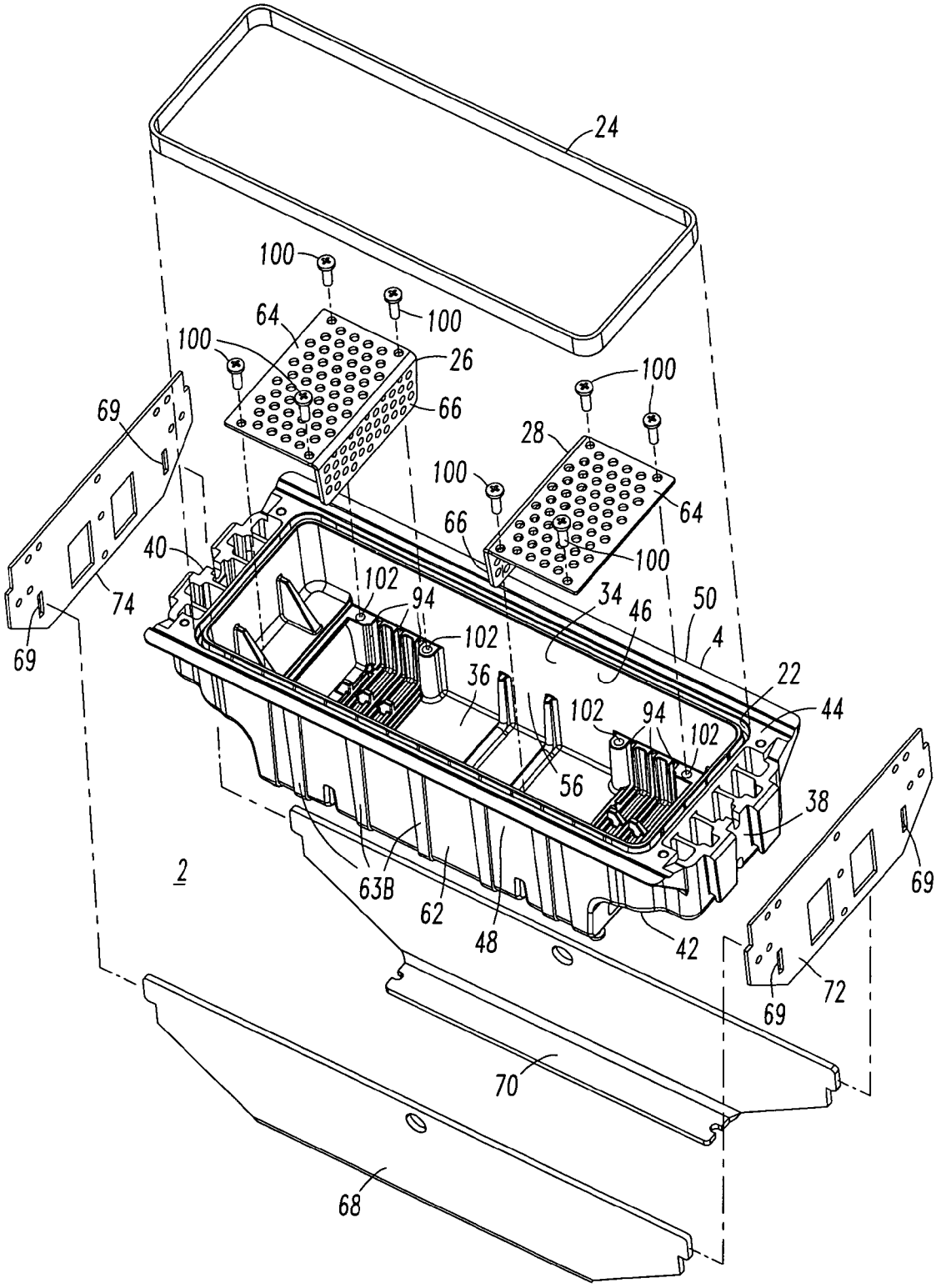
FIG. 3 is an exploded bottom isometric view of the arc hood assembly of FIG. 1.
Figure 9:
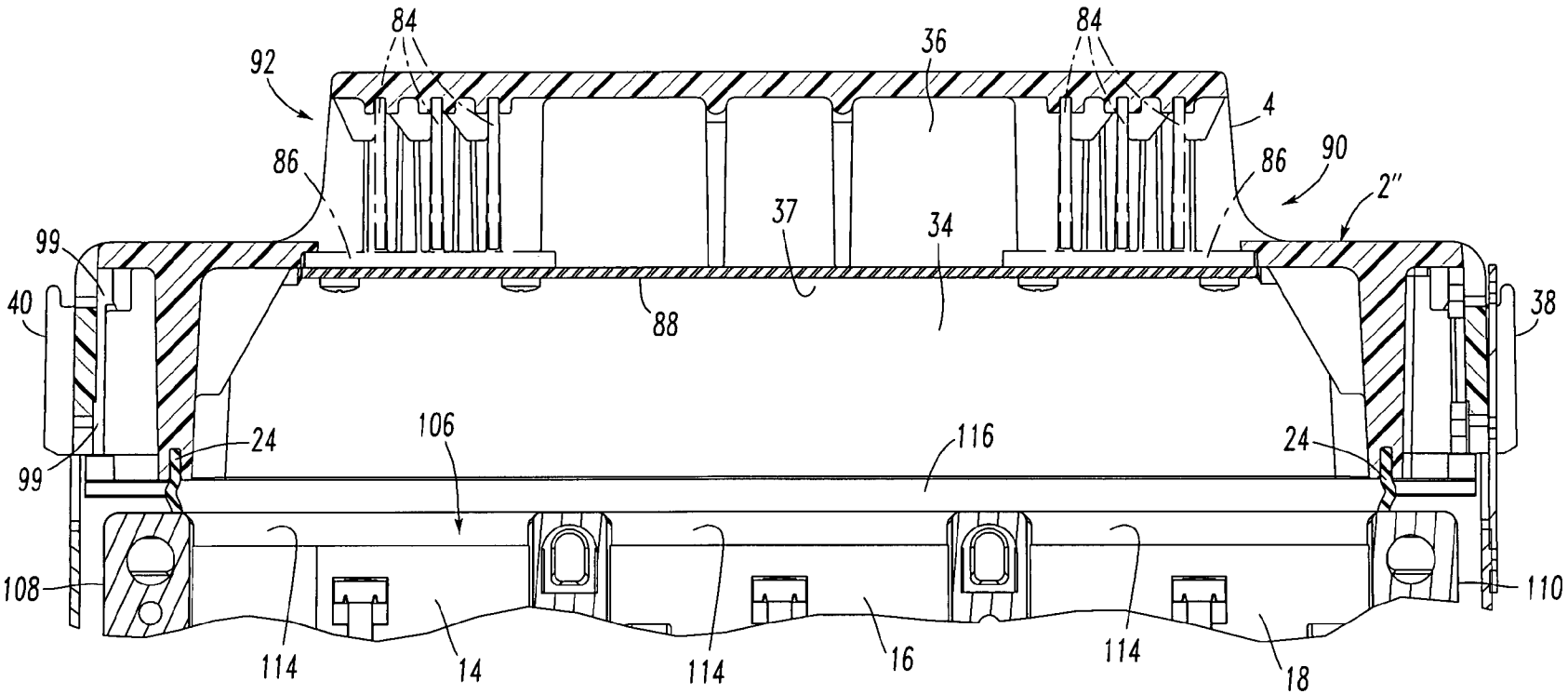
FIG. 9 is a cross sectional view along lines 9—9 of FIG. 8.

The lower edge 20 of the molded shell 4 contains a groove 22 (as shown in FIG. 3) which retains a compliant elastomer seal 24 (as shown in FIGS. 1 and 3) disposed therein. The seal 24 contacts, for example, the circuit breaker housing 10 (FIG. 8), effectively eliminating a leakage path for gas exiting circuit breaker vents 114 (FIG. 9).

One or more baffles, such as 26,28 (FIGS. 1 and 3), serve to redirect the gas, in order that it loses velocity and the peak pressure is diffused. These baffles 26,28 also expose the gas to increased surface area and the gas flows toward the exits 30,32 (FIGS. 2 and 4), absorb heat from the gas, and de-ionize it before allowing it into the general enclosure space. The throttling of the flow cools the gas. Hence, any metals that are evaporated from conductors during arcing condense on the baffles 26,28.

Figure 4:
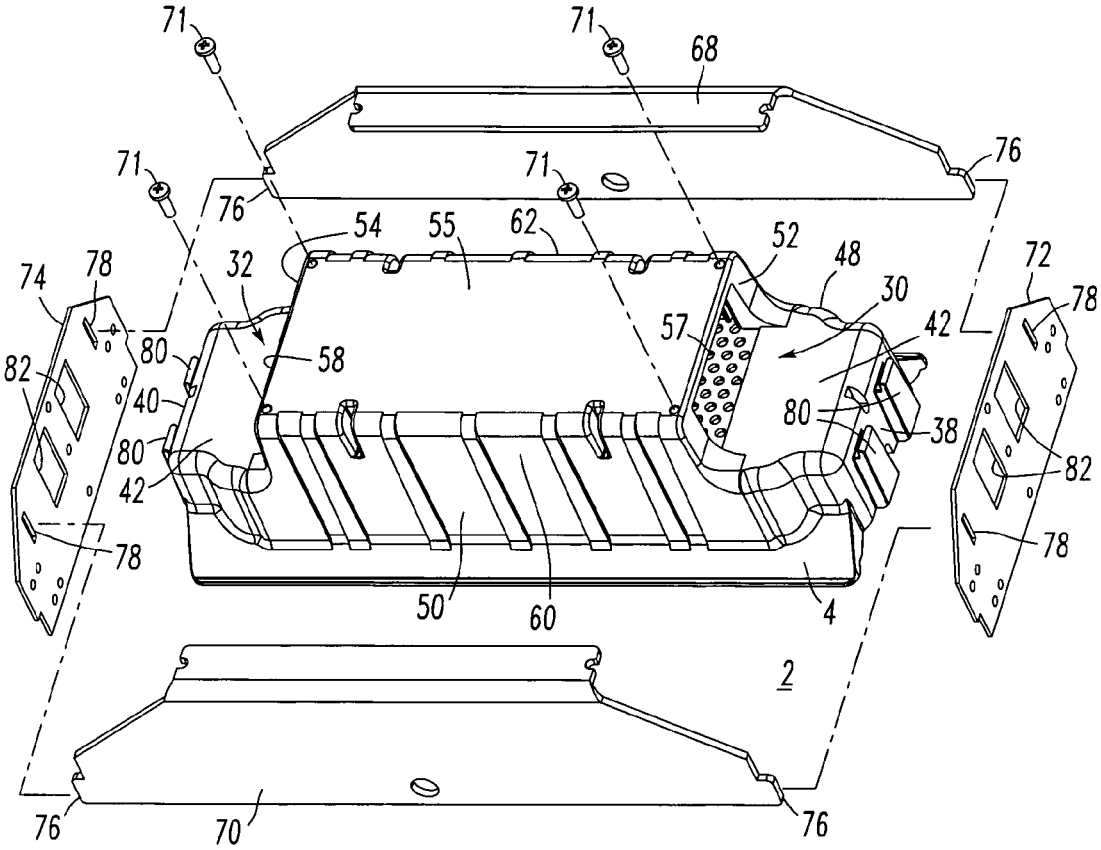
FIG. 4 is an exploded top isometric view of the arc hood assembly of FIG. 1.

The molded shell 4 (FIGS. 1 and 3) includes a first lower chamber 34 and a smaller second upper chamber 36. As shown in FIGS. 3 and 4, the first chamber 34 includes two ends 38,40, a top 42, a bottom 44 having an opening 46 and two sides 48,50. The second chamber 36 is disposed on the first chamber top 42 and includes, as shown in FIG. 4, two ends 52,54, a top 55, a bottom 56 (FIG. 3) and two sides 60,62. The ends 52,54 of the second chamber 36 have openings 57,58 that form the respective exits 30,32 and that are disposed above the first chamber top 42. The openings 57,58 are recessed from the corresponding first chamber ends 38,40. The two chambers 34,36 define a passageway 37 (FIG. 1) between the entrance opening 46 of the bottom 44 of the first chamber 34 (FIG. 3) and the openings 57,58 of the ends 52,54 (FIG. 4) of the second chamber 36. The baffles 26,28 are within the molded shell 4 and are disposed between the entrance opening 46 and the exit openings 57,58. The seal 24 is disposed about the opening 46 of the bottom 44 of the first chamber 34.

The molded shell 4 is preferably designed with relatively thick walls (e.g., at the sides 48,50, ends 38,40,52,54, top 55 and bottom 56), ribs 63A (as best shown in FIG. 1), gussets 63B (as best shown in FIG. 3) and relatively large radii in order to withstand the high pressure shock wave from circuit interruption. A wide range of other mounting features may be included in the molded shell 4 for reinforcement or alternative needs. For example, nut pockets 99 (FIGS. 1 and 9) with grooves for bolts and holes, such as 102 (FIG. 3), for self-tapping fasteners may be included.

As best shown in FIG. 3, the baffles 26,28 include the first L-shaped baffle or plate 26 and the second L-shaped baffle or plate 28. Each of the baffles 26,28 has a first portion 64 that is generally parallel to the bottom 44 of the first chamber 34 and a second portion 66 that is generally parallel to a corresponding one of the ends 52,54 (FIG. 4) of the second chamber 36. The bottom 44 of the housing first chamber 34 includes the groove 22 proximate the opening 46.

Two optional side plates 68,70 may be added for strength, when needed. The side plates 68,70 are secured to the top 55 of the housing first chamber 36 by screws 71 as shown in FIG. 4. The side plates 68,70 (when used) are supported by slots 69 in the end plates 72,74 or by cassette sides (not shown). The tabs 76 are received by openings 78 of the end plates 72,74. The molded shell 4 includes integral features for mounting, such as two projections, such as mounting lugs 80, at each of the ends 38,40. Those projections are received by openings 82 of the end plates 72,74.

Figure 5:
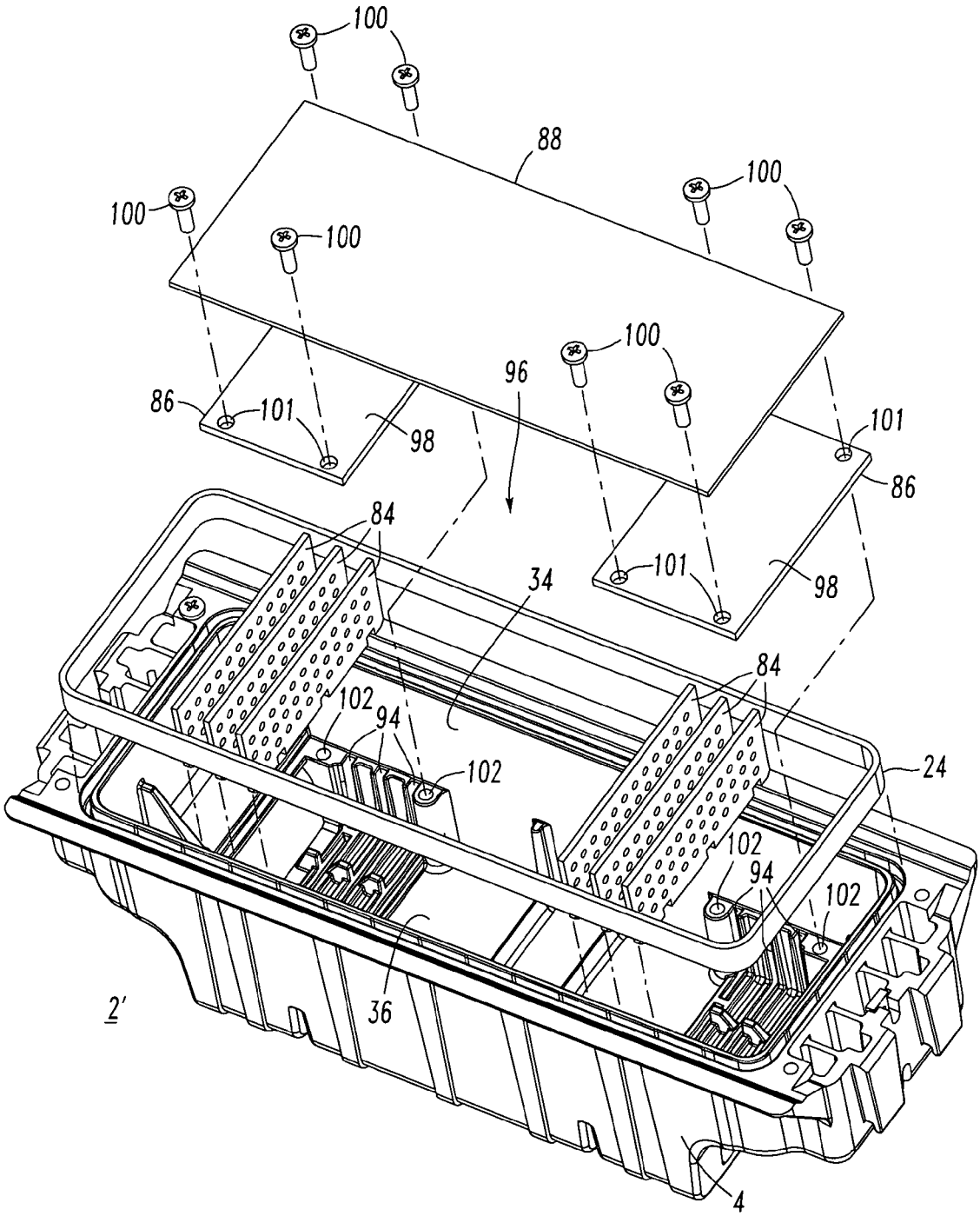
FIG. 5 is an exploded bottom isometric view of another arc hood assembly including a plurality of baffles in accordance with another embodiment of the invention.
Figure 6:
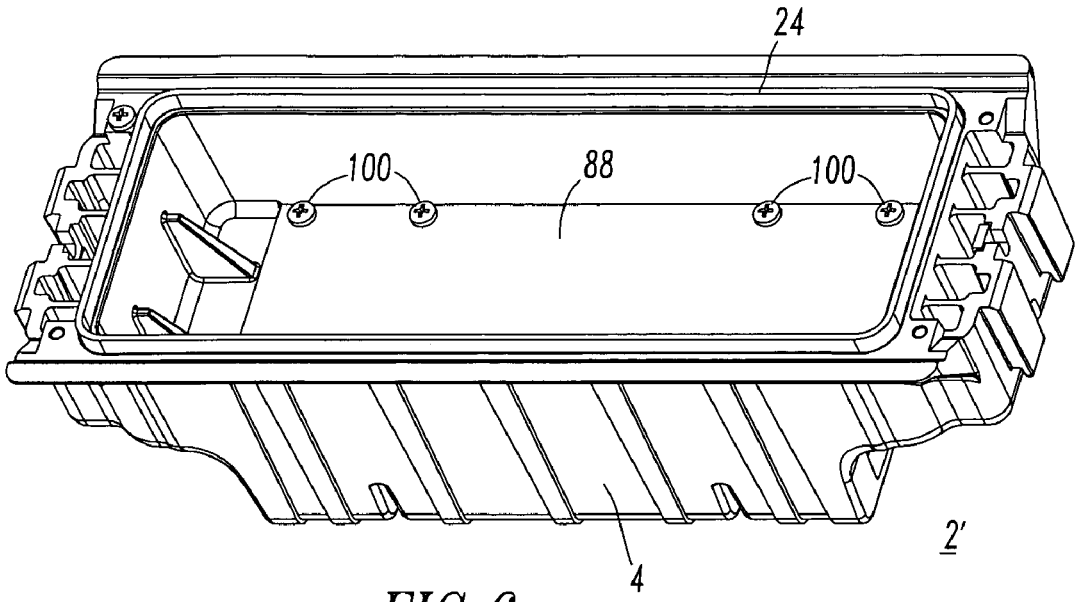
FIG. 6 is a bottom isometric view of the arc hood assembly of FIG. 5.
Figure 7:
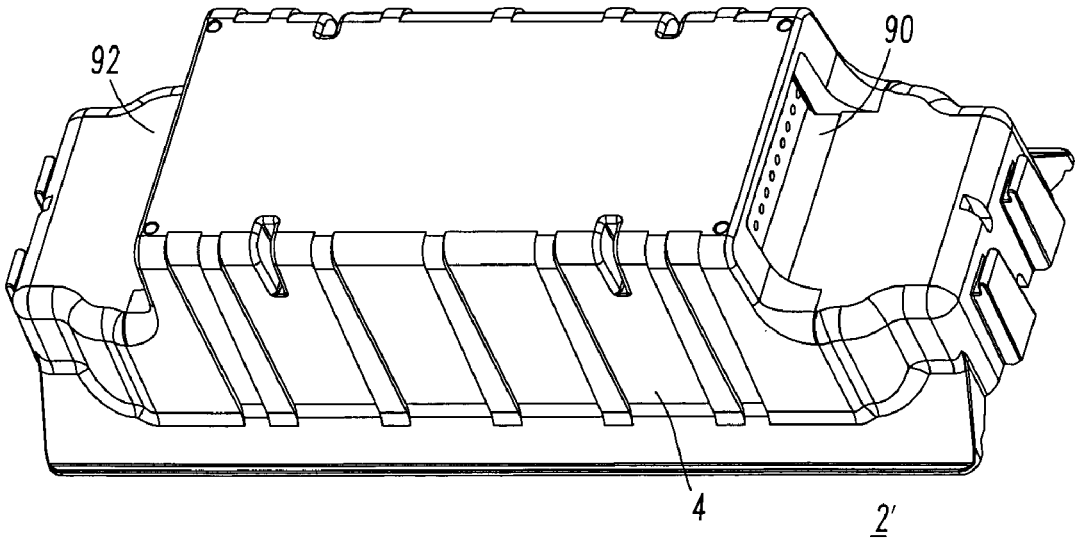
FIG. 7 is a top isometric view of the arc hood assembly of FIG. 5.

Referring to FIGS. 5–7, another arc hood assembly 2' is shown, which is somewhat similar to the arc hood assembly 2 of FIGS. 1–4. The arc hood assembly 2', however, includes a plurality of baffles 84,86,88 as will be discussed. The baffles 84 include a plurality (e.g., without limitation, one or more baffles 84 per end) of vertical (with respect to FIG. 5) plates. The baffles 86 are two holding plates, one at each end. The baffle 88 is a horizontal (with respect to FIG. 5) screen. Although examples of the baffles 84,86,88 are disclosed, it will be appreciated that a wide range of one or more suitable baffles may be employed, such as, for example, the L-shaped baffles 26,28 of FIG. 3.

For example, the vertical (with respect to FIG. 5) baffles 84 may be screens or may be made of wire mesh or perforated metal or other suitable sheet material. The baffles 84 are arranged inside the exits 90,92 (FIG. 7) of the arc hood assembly 2' such that gas must flow through one or more of the baffles 84 before exiting. Such baffles 84 may include bent flanges (not shown) along some edges, in order to stiffen them against the gas flow pressure.

The baffles 84 are retained by the horizontal (with respect to FIG. 5) plates 86, which capture the baffles 84 in grooves 94 molded in the molded shell 4. The horizontal plates 86 function to divert the gas through the baffles 84 before exiting the exits 90,92 (FIG. 7), with a suitable gap 96 between the two plates 86 serving as a passage between the lower chamber 34 of the molded shells 4 and the central upper chamber 36 from which gas exits to the exits 90,92. The horizontal screen 88 is placed against, or suitably spaced off of, the bottom (i.e., the top of FIG. 5) surface 98 of the horizontal plates 86. The horizontal screen 88 functions, like the vertical (with respect to FIG. 5) baffles 84, to absorb heat and shock energy, to cool the gas, to condense metal vapor and to diffuse the gas flow.

The plates 86 and horizontal screen 88 are held in place within the molded shell 4 by screws 100 that pass through openings 101 of the plates 86 and openings (not shown) of the screen 88. The screws 100 engage the molded shell 4 at openings 102. The other components, such as the baffles 84, are retained inside the molded shell 4 using molded-in assembly features, such as the grooves 94. These components are assembled from inside the molded shell 4 from the bottom of FIG. 5 upward, such that high pressure exhaust gas, that moves from the top to the bottom of FIG. 5 (and toward the exits 90,92 of FIG. 7) will only further seat them in their mounting features.

Figure 10:
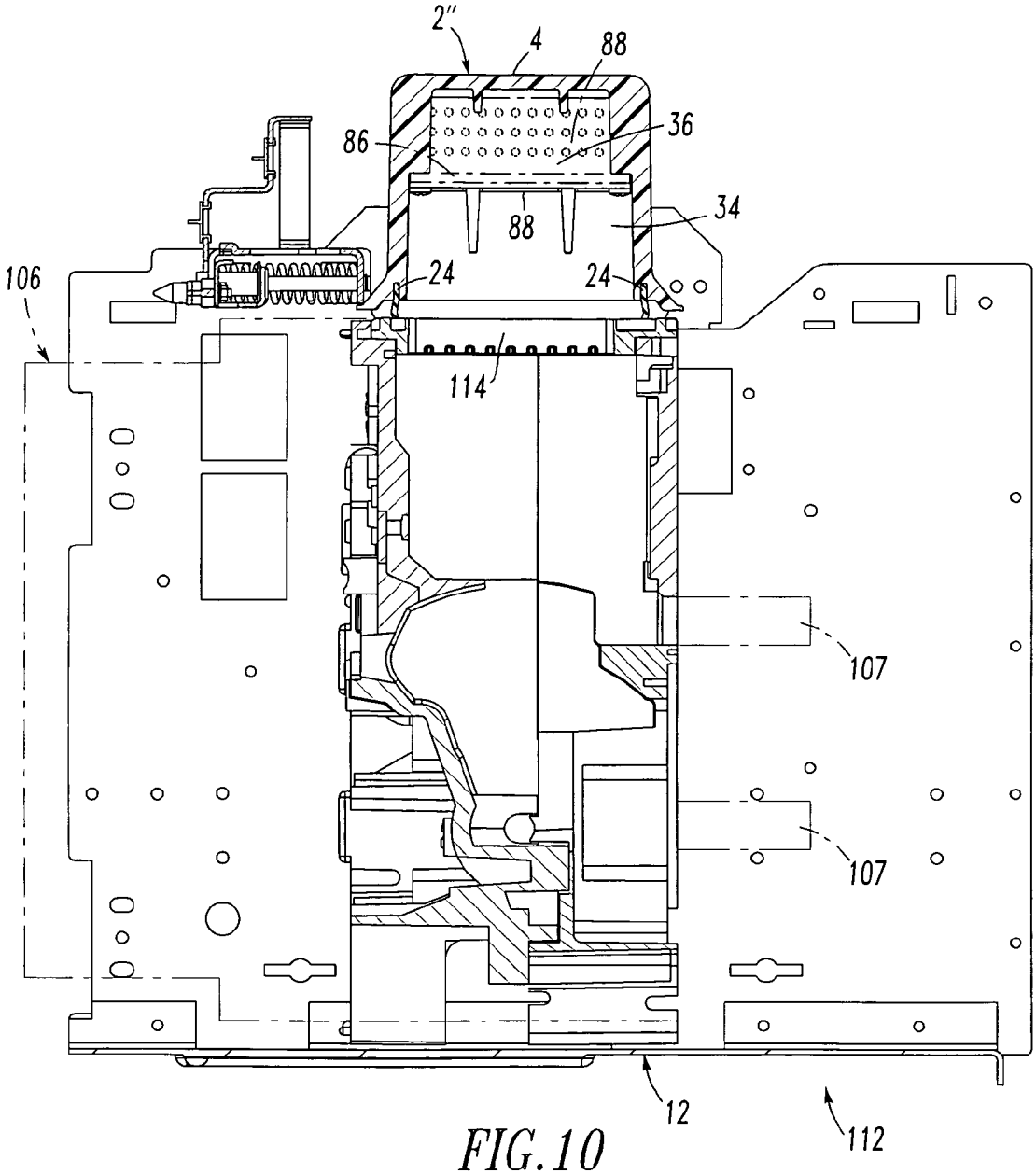
FIG. 10 is a cross sectional view along lines 10—10 of FIG. 8 showing a vent of the circuit breaker.

Referring to FIGS. 8–10, the circuit breaker cassette 10 and another arc hood assembly 2" are shown. The arc hood assembly 2" may be similar to the arc hood assemblies 2 (FIGS. 1–4) or 2' (FIGS. 5–7). As was discussed above in connection with FIG. 4, the mounting lugs 80 at the ends of the molded shell 4 interlock with the end plates 72,74, which, in turn, are coupled to the cassette sides 6,8 by fasteners 104, which positively retain the assembly 2" without any additional fasteners. Alternatively, the end plates 72,74 are not needed and the mounting lugs 80 may engage openings (not shown) in the cassette sides 6,8.

As shown in FIG. 9, one or more baffles, such as 88, are disposed above the lower (with respect to FIG. 9) first chamber 34 of the molded housing 4. The baffle(s) 88 is (are) offset from the ends 38,40 of the lower first chamber 34. The cassette 12 of FIG. 8 carries a circuit breaker 106 (FIGS. 9 and 10) including a pair of ends 108,110 and the plurality of poles 14,16,18. The baffle(s) 88 is (are) also offset from the circuit breaker ends 108,110. Although not included in the assembly 2", as shown, the other baffles 84,86 may be added thereto. Furthermore, the baffles 26,28 of FIG. 3 may be employed. There is no gap between the seal 24 and the circuit breaker 106 when the circuit breaker is fully inserted (e.g., racked-in). The compliant seal 24 touches the circuit breaker 106 and compresses or deflects, thereby closing the gap.

As shown in FIG. 10, the circuit breaker 106 is included in a power distribution system 112. The circuit breaker 106 includes terminals 107 and one or more vents, such as 114 (three vents 114 are shown in FIG. 9). The arc hood assembly 2", which extends over at least a portion of the one or more vents 114, is disposed at least partially adjacent the circuit breaker 106 and is structured to direct arc gases discharged by such circuit breaker through the opening 116 (FIG. 9) of the bottom of the lower housing chamber 34, through the passageway 37, through the one or more baffles, such as 88, within the molded shell 4, and through the exits 90,92 (FIGS. 8 and 9) of the smaller upper chamber 36.

Figure 11:
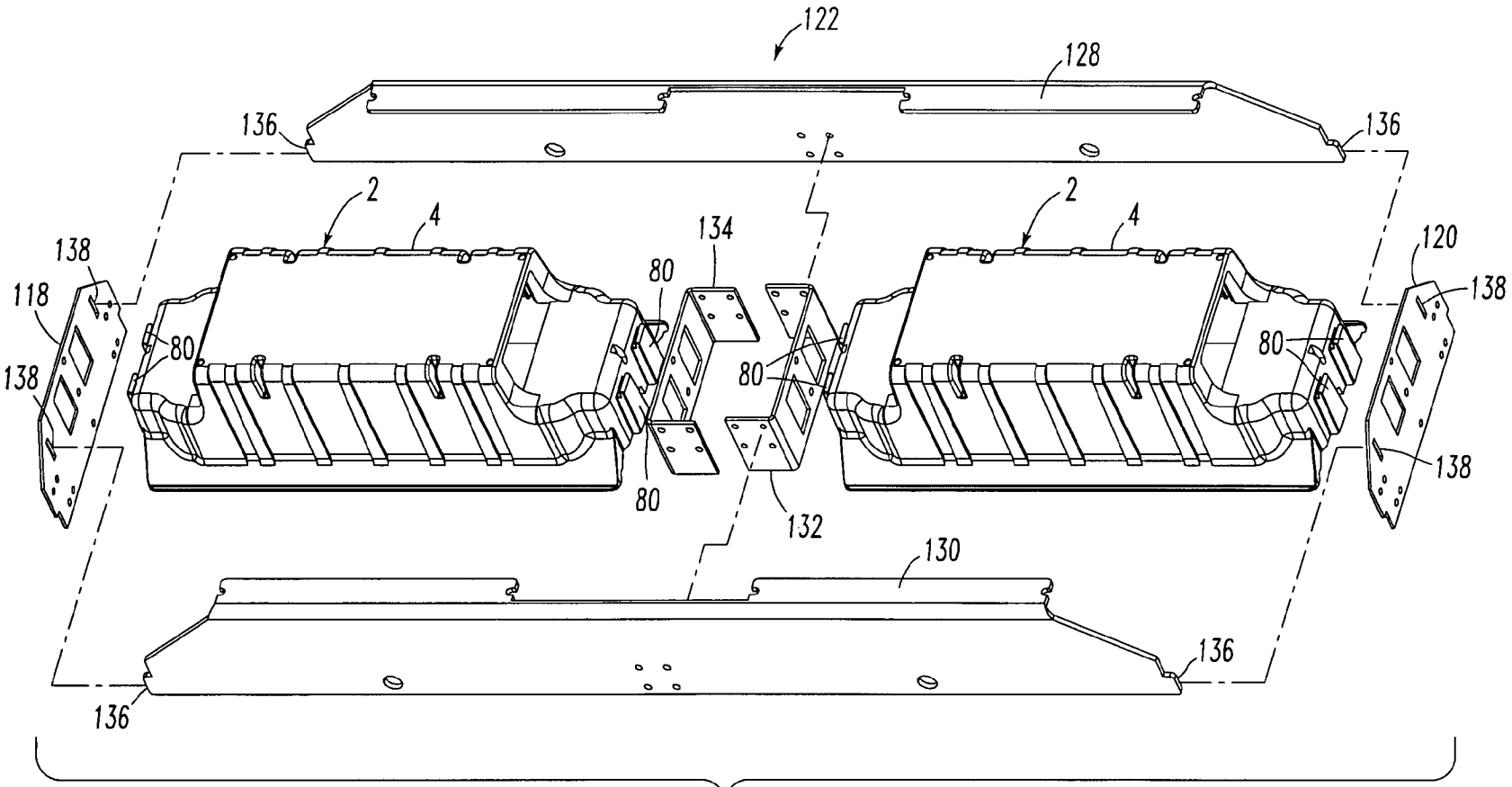
FIG. 11 is an isometric view of portions of one double-width circuit breaker cassette and two of the arc hood assemblies of FIG. 1.

FIG. 11 shows portions 118,120 of one double-width circuit breaker cassette (e.g., for six pole units with two pole units paralleled per phase) 122 and two of the arc hood assemblies 2 of FIG. 1. Although the assemblies 2 are shown, any of the other assemblies 2' (FIGS. 5–7) and 2" (FIGS. 8–10) may be employed. The portions 118,120 are somewhat similar to the mounting end plates 72,74 of FIG. 4, and may be an integral part of, or else be suitably coupled to, the cassette 122.

The two assemblies 2 are joined end-to-end using the projections, such as the mounting lugs 80, at the ends of the molded shells 4, for use over a double-width circuit breaker (not shown) disposed within the cassette 122. Such double-width circuit breakers, for example, use multiple poles connected in parallel for one or more phases in order to increase current capacity. In addition to the cassette portions 118,120 at the opposite ends of the two molded shells 4, the U-shaped plates 132,134 engage the mounting lugs 80 at the adjacent ends of the molded shells 4. Similar to the side plates 68,70 of FIG. 4, the side plates 128,130 include tabs 136 that engage the cassette portions 118,120 at openings 138. The U-shaped plates 132,134 are suitably coupled to the side plates 128,130 by fasteners (not shown).

Figure 12:
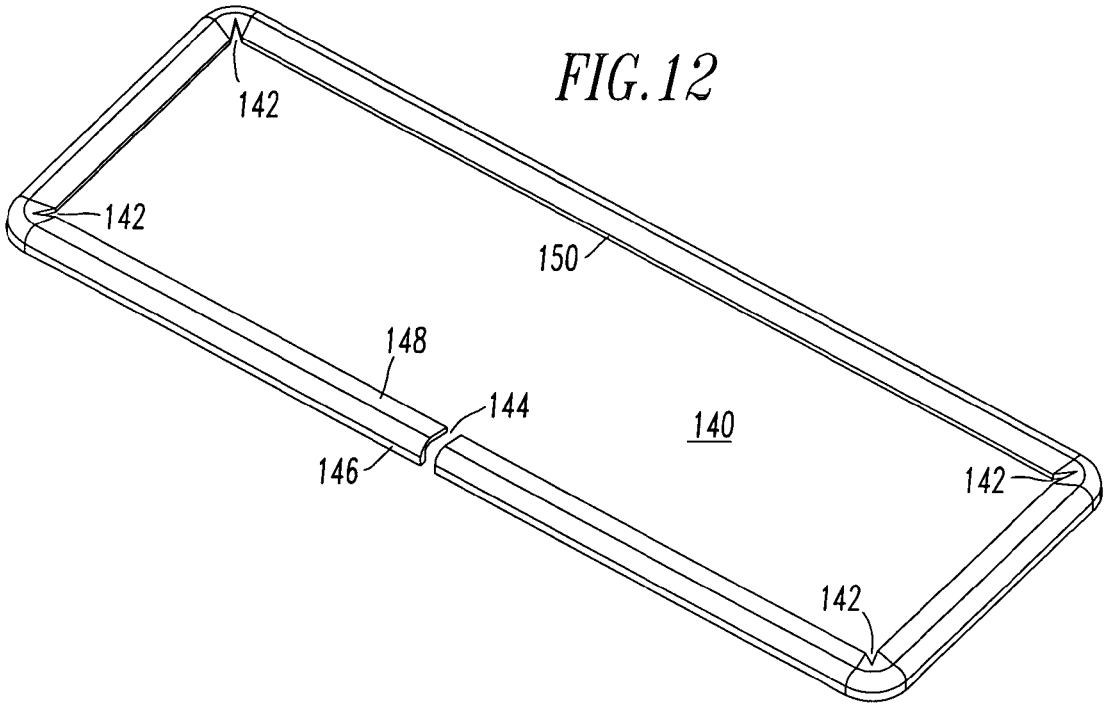
FIG. 12 is an isometric view of a seal having an L-shaped cross section for the molded shell of FIG. 1 in accordance with another embodiment of the invention.

Referring to FIG. 12, as an alternative to the seal 24 of FIGS. 1 and 3, a seal 140 having an L-shaped cross-section may be employed. It will be appreciated that the seal 140 may be extruded, in which case the corners of the seal 140 may have notches 142, in order to accommodate the bends at the four corners of the groove 22 of FIG. 3, with a nominal gap 144 being at the ends of the extrusion. Alternatively, the seal 140 may be molded (not shown), in which case the notches 142 and the gap 144 are not employed. A first portion 146 of the L-shape is adapted to be disposed in the groove 22 (FIG. 3) and a second portion 148 has a free end 150 that is adapted to be disposed toward the opening 46 (FIG. 3) of the bottom of the lower first chamber 34 (FIG. 3).

Figure 13:
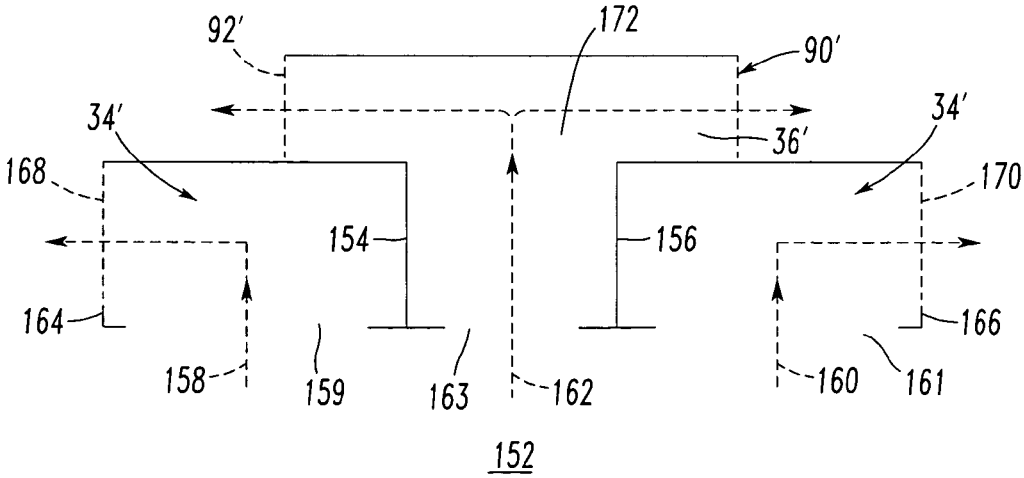
FIG. 13 is a simplified cross sectional view of a molded shell for an arc hood assembly including two dividers for directing gas from a left pole toward the left side of a lower chamber, directing gas from a right pole toward the right side of the lower chamber, and directing gas from a center pole upward and then toward the left and toward the right of an upper chamber.

FIG. 13 shows a simplified cross sectional view of another molded shell 152 that is somewhat similar to the molded shell 4 of FIGS. 1–11. The molded shell 152 includes two internal dividers 154,156 for directing gas in the lower chamber 34' of the molded shell 152. The divider 154 directs gas 158 at entrance 159 from a left (with respect to FIG. 13) circuit breaker pole (not shown) toward the left in the lower chamber 34' of the molded shell 152. The divider 156 directs gas 160 at entrance 161 from a right (with respect to FIG. 13) circuit breaker pole (not shown) toward the right in the lower chamber 34' of the molded shell 152. The dividers 154,156 cooperate to direct gas 162 at entrance 163 from a central (with respect to FIG. 13) circuit breaker pole (not shown) toward the upper chamber 36' of the molded shell 152, which, in turn, directs that gas to the exits 90',92'. The ends 164,166 of the lower chamber 34' include a first opening or exit 168 for the gas 158 and a second opening or exit 170 for the gas 160. The chambers 34',36' and the dividers 154,156 cooperate to define an opening 172 for the gas 162 between the chambers 34',36' and between the dividers 154,156.

Figure 14:
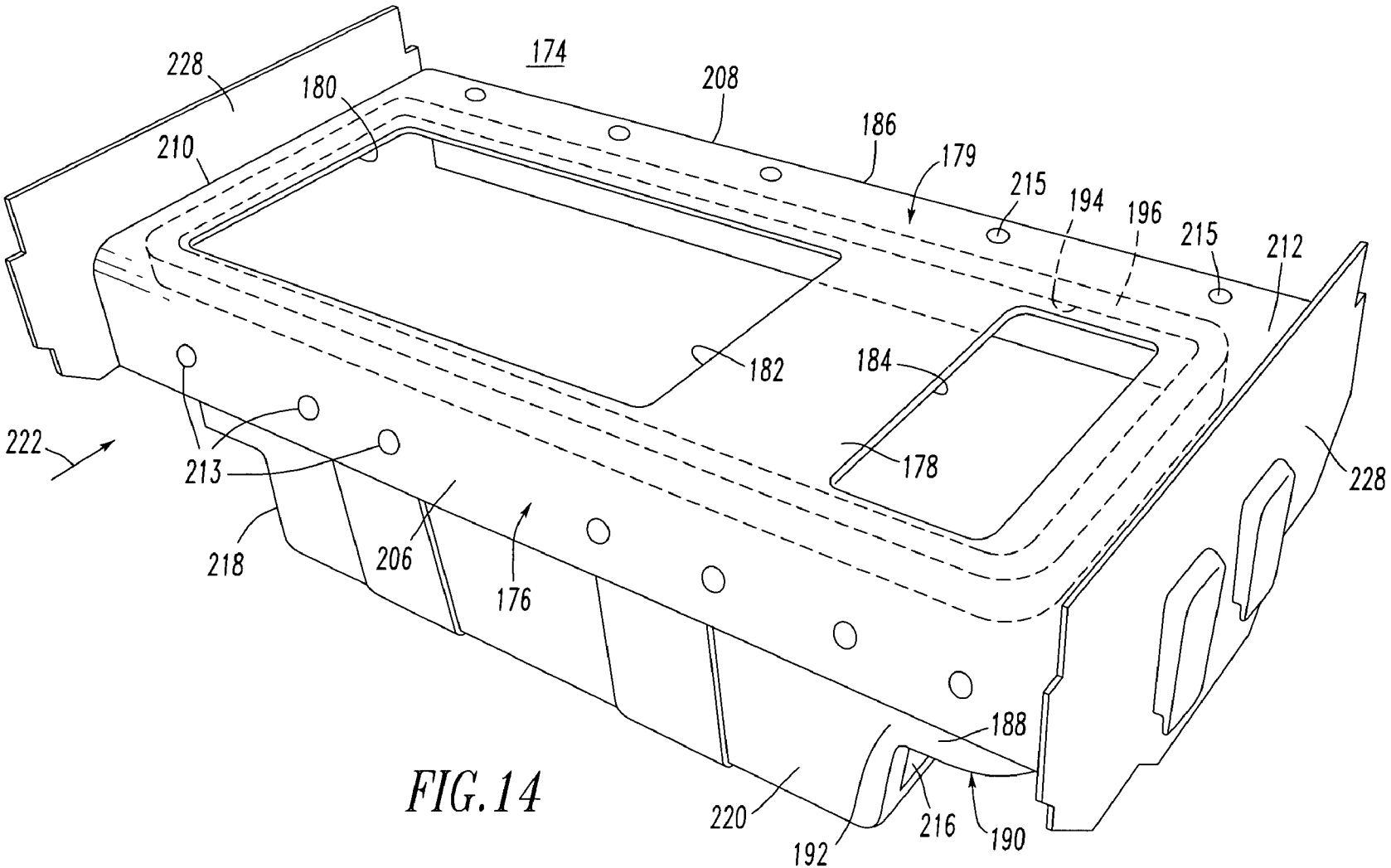
FIGS. 14 and 15 are isometric views of an arc hood assembly including a movable seal in accordance with another embodiment of the invention.
Figure 15:
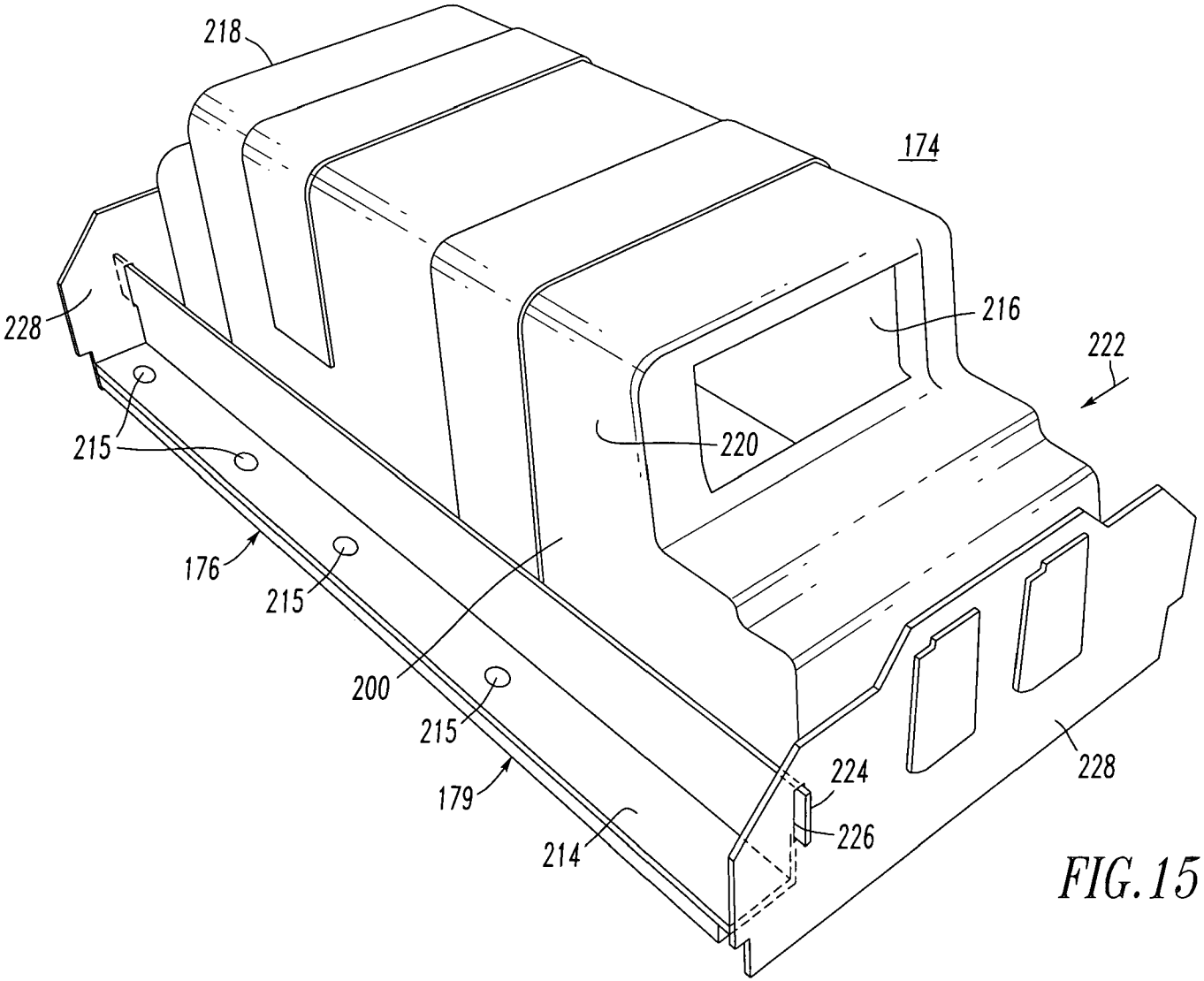

FIGS. 14 and 15 show another arc hood assembly 174 that is somewhat similar to the arc hood assemblies 2,2',2", except that the seal 24 (FIG. 1) is replaced by a movable seal 176. As shown in FIG. 14, the movable seal 176 includes a flat portion 178 with three openings 180,182,184, and a movable portion 179 at one end 186. The lower first chamber 188 of the molded shell 190, which is similar to the molded shell 4 (FIG. 1), includes a first side 192 (FIG. 14) proximate the opening 194 (shown in hidden line drawing in FIG. 14)

of the bottom 196 (shown in hidden line drawing in FIG. 14) and a second side 200 (FIG. 15) proximate the bottom opening 194. The movable seal 176 includes a top portion 202, a bottom portion 204 (shown in hidden line drawing in FIG. 14), a first side 206, a second side 208 and two ends 210,212. The seal top and bottom portions 202,204 have the three openings 180,182,184 therebetween. The first seal side 206 pivotally engages (e.g., although fasteners 213 couple the first seal side 206 to the first chamber first side 192, any suitable pivot mechanism may be employed) the first chamber first side 192, and the second seal side 208 has a rigid L-shaped flange 214 adapted to engage the first chamber second side 200. The second seal side 208 is engaged to the flange 214 (FIG. 15) by a plurality of fasteners 215, although any suitable coupling mechanism may be employed. The movable seal 176 is adapted to pivot in a first direction about the first seal side 206. The second seal side 208 is adapted to alternately move away from the molded shell 190 and move toward the molded shell 190 until the flange 214 of the second seal side 208 engages the first chamber second side 200.

The moveable seal 176 is made of a flexible material (e.g., vulcanized fiber sheet) that allows the circuit breaker (not shown) to contact the seal 176 and deflect it, pivoting one edge (at side 206) and lifting the moveable edge (at side 208).

The circuit breaker (not shown) enters the cassette (not shown) in direction 222, deflecting the moveable seal 176 upward (with respect to FIG. 15) resulting in close contact and minimal gas leakage from the molded shell 190. The pivoting edge (at side 206) will not catch on the edges of the circuit breaker due to the wrap-around design.

As gas moves from the circuit breaker vents (not shown) (such as the vents 114 of FIG. 9) through the openings 180,182,184, the gas pressurizes the lower first chamber 188 of the molded shell 190 before the gas exits the exits 216,218 (FIG. 15) of the upper second chamber 220. As that pressurization occurs, the movable portion 179 of the movable seal 176 pivots downward to engage the circuit breaker (not shown) (such as is shown with the seal 24 and circuit breaker 106 of FIG. 10).

As shown in FIG. 15, the tab 224 of the rigid L-shaped flange 214 extends through a slot 226 of the end plate 228. The slot 226 guides the tab 224 upward and downward.

EXAMPLE 1

The molded shell 4 of FIGS. 1–11 is preferably made of glass filled polyester or a suitable glass filled epoxy (e.g., G-10; G-11) or another suitable high strength thermo-set material.

EXAMPLE 2

The metal wire mesh of the vertical baffles 84 (FIG. 5) may be made of 1010 steel (plated), a suitable stainless steel (e.g., 303; 304; 410), a suitable perforated metal, or a plurality of layers of metal mesh.

EXAMPLE 3

The mesh size of the metal wire mesh of Example 2 may range from 2×2 to 400×400 with multiple layers.

EXAMPLE 4

The metal wire mesh of Example 2 may employ standard, space or milling grades.

EXAMPLE 5

The perforated metal hole size of the vertical baffles 84 (FIG. 5) may range from about 0.024 in. to about 0.375 in. diameter with about 20% to about 60% opening.

EXAMPLE 6

The seal 24 (FIG. 3) may be a rubber gasket made of, for example, Viton®, neoprene, polyurethane, BUNA-N (nitrile), Teflon®, silicone, or ethylene-propylene.

EXAMPLE 7

As best shown in FIG. 9, the one or more baffles may be the single baffle 88 that is a generally planar horizontal (with respect to FIG. 9) screen disposed between the lower (with respect to FIG. 9) first chamber 34 and the smaller upper (with respect to FIG. 9) second chamber 36.

EXAMPLE 8

As best shown in FIGS. 5 and 9, the one or more baffles may include one or more first screens 84 and one or more second screens 84, each of the first and second screens 84 being generally parallel to a corresponding one of the exits 90,92 (FIG. 7) of the smaller second chamber 36.

EXAMPLE 9

Although not shown in FIG. 1, the arc hood assembly 2 may include one or more first generally parallel screens 84 (FIG. 5) and one or more second generally parallel screens 84 (FIG. 5), each of the first and second screens 84 being in a corresponding one of the grooves 94 (FIG. 1) and being generally parallel to a corresponding one of the exits 30,32 of the smaller second chamber 36.

EXAMPLE 10

Although not shown in FIG. 1, the arc hood assembly 2 may include a screen, such as 88, in the passageway 37 between the opening 46 of the bottom 44 of the first chamber 34 and the exits 30,32 of the smaller second chamber 36.

EXAMPLE 11

As a further refinement of Example 9, the first portion 64 of the L-shaped baffles 26,28 may be a plate that is generally normal to and engaging the generally parallel first and second screens 84.

EXAMPLE 12

The geometry of the molded shell 4 (FIGS. 1–4), alone, is an advantage over known prior arc hood designs, even without one or more baffles, such as 26,28,84,86,88, to cool the gas. The molded shell 4 provides a very well controlled and isolated gas path, and a reservoir, which keeps exhaust gas out of contact with grounded metal long enough to avoid unacceptable ground currents in some applications. The internal chambers of the molded shell 4, alone, would also contain the highest peak pressures (or shock wave) sufficiently to reduce damage elsewhere in the switchgear. Throttling the exhaust gas through the limited area exits 30,32 thermodynamically cools the gas and limits the release of damaging explosive pressure. Adding one or more baffles, such as 26,28,84,86,88, further improves the cooling and diffusing effects needed for some applications, but may not be necessary in all applications.

EXAMPLE 13

Especially in the absence of exit baffles, as was discussed above in connection with Example 12, where the exits 30,32 are less restricted and the molded shell 4 is not containing as much gas pressure, or in less demanding applications, the need for a seal, such as 24, might be diminished. In less demanding applications (e.g., relatively lower current and relatively lower voltage applications, but still requiring improved arc gas protection), the routing of the gas through the internal chambers of the molded shell 4 and keeping its direct flow path clear of grounded metal may be adequate protection without a seal. If the gas has an unrestricted exit path, then it has less tendency to push through the small gap above the circuit breaker (e.g., 106 of FIGS. 9 and 10) in a quantity sufficient to cause unacceptable arcing to ground or damage and debris in the corresponding enclosure.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A power distribution system comprising:

a switchgear cabinet;

a circuit breaker carried by the switchgear cabinet, said circuit breaker including at least one vent;

an arc hood comprising:

a housing comprising:

a first chamber comprising two ends, a top and a bottom having an opening, and a smaller second chamber disposed on the top of said first chamber, said smaller second chamber including two ends, a top and a bottom, each of the ends of said smaller second chamber having an opening, being disposed above the top of said first chamber, and being recessed from a corresponding one of the ends of said first chamber, said smaller second chamber and said first chamber defining a passageway between the opening of the bottom of said first chamber and the openings of the ends of said smaller second chamber;

at least one baffle within said housing and being disposed between the opening of the bottom of said first chamber and the openings of the ends of said smaller second chamber; and a seal disposed about the opening of the bottom of said first chamber.

2. The power distribution system of claim 1 wherein said circuit breaker includes at least one pole.

3. The power distribution system of claim 1 wherein said arc hood extends over at least a portion of said at least one vent of said circuit breaker.

4. The power distribution system of claim 1 wherein said arc hood is disposed at least partially adjacent said circuit breaker and is structured to direct arc gases discharged by said circuit breaker through the opening of the bottom of said lower chamber of said housing, through said passageway, through said at least one baffle within said housing, and through the openings of the ends of said smaller upper chamber.

5. The power distribution system of claim 1 wherein said at least one baffle is above the first chamber of said housing.

6. The power distribution system of claim 1 wherein said at least one baffle is offset from the ends of said lower chamber of said housing.

7. The power distribution system of claim 1 wherein said circuit breaker includes a pair of ends; and wherein said at least one baffle is offset from the ends of said lower chamber of said housing and from the ends of said circuit breaker.

* * * * *